United States Patent [19]

Flick et al.

[11] Patent Number: 4,646,600

[45] Date of Patent: Mar. 3, 1987

[54] CUTTING PRESS WITH TOOL MAGAZINE

[75] Inventors: Willi Flick; Walter Bredow, both of Alfeld, Fed. Rep. of Germany

[73] Assignee: C.Behrens AG, Alfeld, Fed. Rep. of Germany

[21] Appl. No.: 745,001

[22] Filed: Jun. 13, 1985

[30] Foreign Application Priority Data

Jun. 15, 1984 [DE] Fed. Rep. of Germany ..... 3422250

[51] Int. Cl.[4] ..... B30B 9/00; B23D 33/02

[52] U.S. Cl. ..... 83/136; 83/549; 83/560; 83/563; 83/698; 29/568

[58] Field of Search ..... 83/104, 549–522, 83/560, 563, 698, 136, 558, 215; 29/568; 72/446

[56] References Cited

U.S. PATENT DOCUMENTS

| | | | |
|---|---|---|---|
| 3,448,645 | 6/1969 | Graf et al. | 83/560 X |
| 4,220,062 | 9/1980 | Blanz | 83/551 X |
| 4,475,424 | 10/1984 | Kouno | 83/558 X |
| 4,486,941 | 12/1984 | Scott et al. | 83/563 X |
| 4,516,447 | 5/1985 | Schneider et al. | 83/551 X |

FOREIGN PATENT DOCUMENTS 2334438 1/1975 Fed. Rep. of Germany .

*Primary Examiner*—James M. Meister
*Attorney, Agent, or Firm*—Michael J. Striker

[57] ABSTRACT

In a cutting press for working plate-shaped workpieces the workpiece is held motor movable normal this direction, the tool is arranged in a lying position in a U-shaped tool receptacle which is movable, and a stationarily arranged drive system is in operative connection with the tool receptacle via a coupling device.

19 Claims, 11 Drawing Figures

4
2
3
32
31
26
3
28
27
70
29
1
115
28'
30
107

CUTTING PRESS WITH TOOL MAGAZINE

BACKGROUND OF THE INVENTION

The present invention relates to a cutting tool with a tool magazine.

Cutting presses of the above mentioned general type are known in the art in many different forms. In these presses conventionally the workpiece, namely a metal sheet to be worked, is motor guided relative to a tool into mutually normal directions on a coordinate table. In correspondence with the complexity of the shapes to be worked, the cutting press must be provided with a respective tool magazine. In revolving cutting presses of this type the tool magazine is designed as a revolving plate rotatable about a vertical axis with a tool held in its peripheral region. In cutting presses with individual head stations the tools are brought or exchanged by hand or automatically from an associated tool magazine. With increasing size of the workpieces there is however the difficulty that for providing a precise working, to exactly guide the same on the coordinate table. Therefore in such presses the solution was to transfer one of these two movements of the workpiece at a right angle relative to one another, to the tool. Here also there is a difficulty, especially in the case of very heavy tools in which during their guidance a desired accuracy of working must be maintained, since considerable masses must be guided very accurately. The latter requires either a ver strong drive with respective structural volumes and weight, or relatively low movement speeds and thereby low output of the cutting press must be accepted. It is known in connection with this to arrange in motor movable manner for actuation of the punching tool, an eccentric shaft and associated parts of the drive system together with the tool, as disclosed in the DE-AS No. 2,334,438. There is also a requirement to have on one cutting press a maximum big tool reservoir for enabling to work also complex sheet shapes.

SUMMARY OF THE INVENTION

Accordingly, it is an object of the present invention to provide a cutting press of the above mentioned general type which avoids the disadvantges of the prior art.

More particularly, it is an object of the present invention to provide a cutting press of the above mentioned type which has a larger tool reservoir and at the same time provides in a simple manner a fast movement for the tool guidance, so that respectively high output rates of the cutting press are attained.

With these objects and with others which will become apparent herein after, one feature of the present invention resides, briefly stated, in a cutting press in which in a working station of the press a drive for a tool is stationary and only a tool receptacle is supported movably in a direction Y, a coupling device is arranged between the drive and the tool receptacle overlapping the movement of the tool receptacle, and a tool magazine is arranged motor movable relative to the working station on a machine frame in a direction X.

It is important that during movement of the tool which in a cutting press includes usually a punch, a stripper and a matrix, only the tool receptacle is supported movably in one direction, whereas the drive associated therewith is stationary. The connection between the tool receptacle and its drive is performed via a coupling device which is designed so that it enables engagement between the stationarily arranged drive and the movable tool receptable over the length of the movement. As a result of this, during movement of the tool the masses to be moved can be retained small, so that with a powerful small drive a fast movement of the tool can be obtained. The workpiece to be worked is supported movably in one direction normal to the movement of the tool in a predetermined manner, so that in connection with similarily movable tool magazine designed for transferring of tool receptacles to the working station or for withdrawing the tool receptacles from the working station, a very powerful cutting press becomes available.

In accordance with another feature of the present invention, the tool receptacles are formed as one-piece elements. The tool receptacles can be formed U-shaped and arranged in a lying position. The end regions of their upper and lower arms ca hold the tool, namely a punch, a stripper and a matrix. Such tool receptacles are geometricly relatively simple and easy to watch, so that handling devices for moving the tool receptacle between the working station and the tool magazine can be designed relatively simply.

Another feature of the present invention is that the upper arm and the lower arm of the tool receptacle are provided with guiding devices which cooperate with the machine frame so that the arms are horizontally slidingly moved and vertically supported at all sides. In this case an especailly stable and precise guiding of the tool is guaranteed, which provides in the event of high mechanical loads a reliable guidance.

A further feature of the present invention is that the tool receptacles are formed of two parts, namely an upper part and a lower part, provided with the guiding devices cooperating with the machine frame. These parts are horizontally slidingly guided and vertically supported at all sides, and the tool arranged in these parts is composed of a punch, a stripper and a matrix. The two-part construction of the tool receptacle provides for space economy. The individual parts of the receptacle are also provided in this case with the guiding devices, to guarantee a precise guidance during mechanical working.

Still a further feature of the present invention is that the coupling device includes a coupling plate which is motor movable with a predetermined stroke and is provided with a longitudinal groove extending in the direction Y and serving for vertical form-locking fixation of a movable part of the tool, namely the punch. A punch holder of the punch can be provided with a coupling pin which is slidingly guided in the longitudinal groove in the direction Y and fixed at all sides vertically. The coupling [pressing] plate is vertically slidingly guided relative to the machine frame, and horizontally fixed at all sides. In this manner a functionally easy observable and very reliable coupling between the tool and the drive system is provided. It is important that the pressing plate has a very accurate vertical guidance and cannot be canted especially under the forces which take place during mechanical working process.

A further feature of the present invention is that the pressing plate is connected with pairs of toggle levers arranged at a distance from one another in the direction Y, wherein both pairs of the toggle levers are connected with one another by a common substantially horizontal pulling rod, and the pulling rod is driven oscillatingly in its direction of elongation. The pair of toggle levers is arranged in a toggle lever bearing housing fixedly connected with the machine frame. The pressing plate is slidingly guided in an open end region of the toggle lever bearing housing, and the toggle levers are turnably connected with the toggle lever bearing housing at one side and with the pressing plate via toggle lever pins at the other side.

The oscillating drive of the system of toggle levers can be performed for example via a stationarily arranged eccentric shaft which is driven by a conventional electric motor. The pressing plate is subjected in this case to a very stable vertical guidance. Since the toggle lever bearing housing performs simultaneously a guiding function for the pressing plate, a very easy arrangement takes place.

Stripper pins held under the action of spring force can be guided in the upper and lower arms of the tool receptacle parallel to the punch, and actuating rails are slidingly arranged on the machine frame for movement of the stripper pin. The actutating rails extend in the direction Y and guided motor slidingly relative to the machine frame. They are in sliding contact by a longitudinal surface with the stripper pin and have a sliding surface inclined in a horizontal plane in the direction Y and being in sliding contact with the respectively inclined guiding surfaces on the machine frame. The actuating rails extend in the direction Y at both sides of the pressing plate and the guiding surfaces are formed in the toggle lever bearing housing. The actuating rails form a part of the inventive coupling device which cooperates with the stripper pins. They are guided in accordance with the present invention on the toggle lever bearing housing so that the inventive coupling device can be brought in one functional element, namely in the toggle bearing housing. The actuating rails extend parallel to the longitudinal groove of the pressing plate and have substantially the same length which corresponds to the movement of the tool in this direction. A vertical movement of the stripper pins is performed so that the actuating rails with lower horizontally extending longitudinal surface in sliding contact with the stripper pins, vertically move the stripper pins by horizontal movement because of their inclined sliding surfaces which cooperate with the respectively inclined guiding surfaces of the machine frame.

Still another feature of the present invention is that the tool receptacles are provided with coupling pieces which cooperate with coupling parts of a drive system for movement of the tool receptacles in the direction Y. The coupling parts of the drive system are formed motor switchable. The drive system includes a ball circulating spindle with one end supported on the machine frame via a motor driven ball circulating nut and with another end carrying the coupling part or parts. In the above construction, in the case of one-part formed tool receptable only one coupling piece is required.

In a two-part tool receptacle the upper and lower parts have a coupling piece, and each coupling piece is associated with a coupling part of the drive system. One coupling part is movable part via the ball circulating spindle and the other coupling part is movable via a connected rod extending parallel to the ball circulating spindle in the direction Y, whereas the connecting rod is coupled via a connecting block kinematically with the ball circulating spindle. In this construction both parts of the two-part tool receptacle can move only jointly. The connecting block is supported in this case movably relative to the machine frame.

The tool magazine is advantageously motor movable between the working station and the magazine station, and the magazine station is arranged for receiving a plurality of tool magazines, whereas any tool magazine is transferred from the magazine station to the working station and vice versa. In this construction the magazine station can be formed with a very high capacity, so that for the mechanical working a respectively wide tool reservoir is available. It is important that the tool magazine located in the magazine station is motor movable in direction to the working station, so that in the working station the individual tool receptacles are available. With the arrangement of a respective location coding of the individual tool receptacles in the tool magazine, an automatic computerized manufacture of complex metal sheet structures is possible.

All guiding elements of the inventive cutting press can be coated with a special sliding material of synthetic plastic with a low friction coefficient, or provided with rollers which also reduce the friction forces.

The novel features of the present invention which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF PREFERRED EMBODIMENTS

Figure 1:
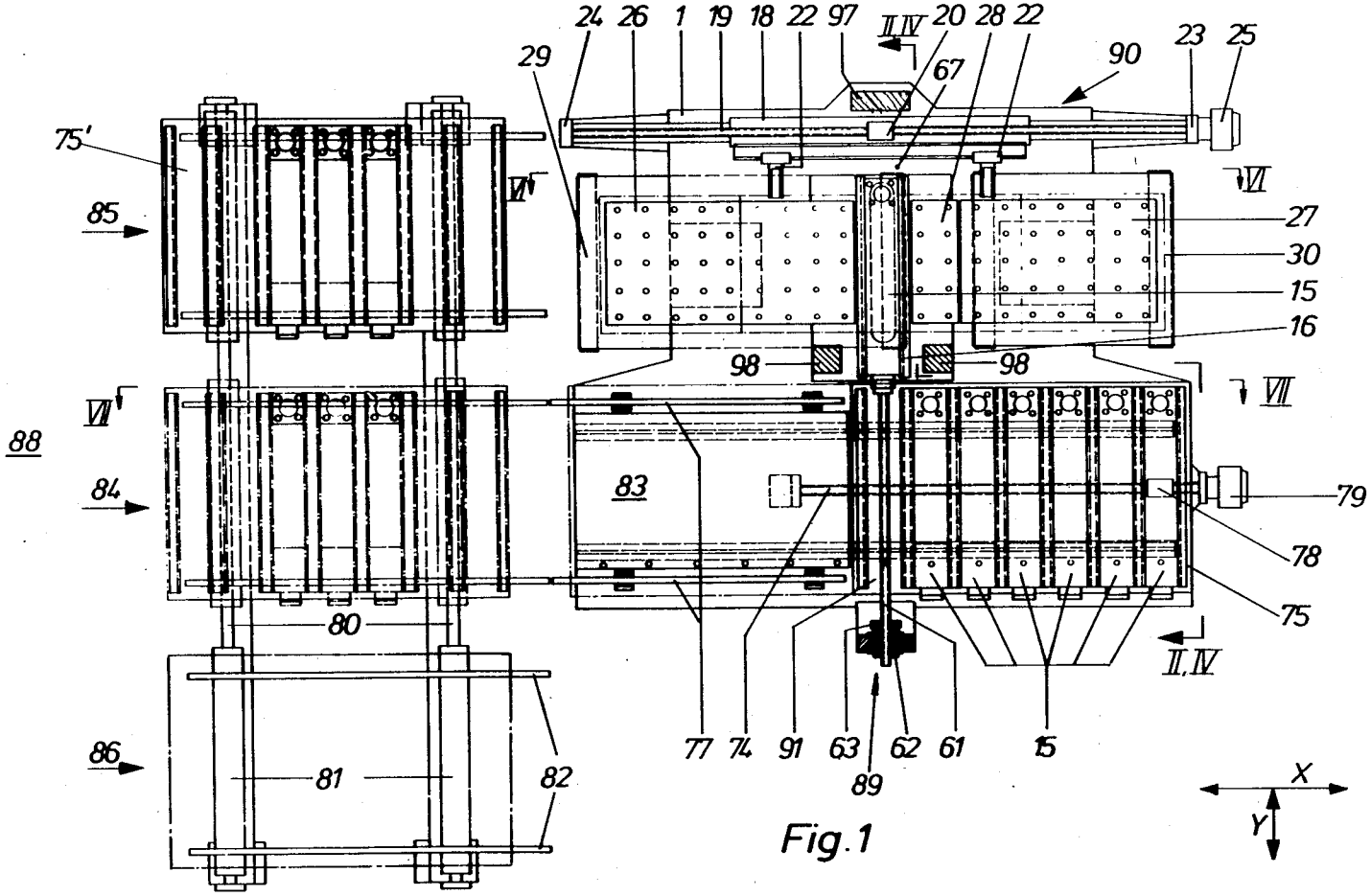
FIG. 1 is a plan view of a cutting press in accordance with the present invention, partially in section.

A cutting press shown in FIG. 1 is a machine frame which is identified with reference numeral 1. The cutting press is used for cutting laminar plane workpieces in chip-free manner. The workpiece to be worked lies at both sides of working station 67 on sheet supports 26 and 27 which are in fixed connection with the machine frame 1.

A ball circulating spindle 19 is located laterally near the sheet supports and supported via spindle end bearings 23 and 24 on the machine frame 1. A servo motor 25 for driving the ball circulating spindle 19 is located near the spindle end bearing 23. Thereby a transverse carriage 18 which is connected with a ball circulating nut 20 engageable with the ball circulating spindle 19, is supported at both ends drivingly in direction of the arrow X. The transverse carriage 18 carries clamping elements 22 which are arranged at a distance from one another, as considered in direction of the arrow X. They serve for holding a not-shown workpiece. The clamping element 22 can have any construction. A conveyor 29 is located under the sheet support 26 and serves for evacuating of metal pieces falling in the region of the working station 67. The finished parts are evacuated by a conveyor belt 30 located under the sheet support 27 and reach there by turning of a flap 28 which is supported turnably about an axis lying in the plane of drawing of FIG. 1. This will be explained in detail later on.

The invention is characterized by U-shaped tool receptacles 15 which will be explained herein below. A tool receptacle which is located in the working station 67 is slidingly guided over a guide track of the machine frame. A tool magazine 75 is located laterally near the sheet supports 26 and 27 and provided in this case with receiving devices for receiving seven tool receptacles 15. These receiving devices are formed as guiding tracks 91. It can be seen that in FIG. 1 the guiding track 91 does not contain any tool receptacle 15, since it is located in the working station 67 and the guiding tracks 91 of the tool magazine 75 are bringable to an aligned position with the guiding tracks 16 of the machine frame.

The tool magazine 75 is supported motor-movably on a guiding track 73 [FIG. 2] in direction of the arrow X, as will be described herein below. For this purpose a servo motor 79 is provided on the machine frame 1 and drives a ball circulating spindle 74 supported at both ends on the machine frame 1. The ball circulating spindle 74 engages with a ball circulating nut 78 [FIG. 2]. The arrangement and mounting will be explained later on.

A ball circulating nut 62 is supported on the machine frame 1 and engages with a ball circulating spindle 61. The end of the ball circulating spindle 61 is coupled with the tool receptacle 15 located in the working station 67 as will be explained. The ball circulating spindle 61 serves for providing a drive for the tool receptacle in direction of the arrow Y. Lifting rails 77 extend at both sides of the guiding track 73 on one end of the machine frame. They serve for transferring a tool magazine 75 to a magazine station 88 as will be explained. The magazine 88 is identified by guiding rails 80 which extend substantially normal to the lifting rails 77 and serve for guiding a displacing carriage 81. The displacing carriage 81 can be motor-driven on the guiding rails 80 substantially between the stations 84, 85 and 86, advantageously by means of not-shown drive. Receiving rails 82 are located on the displacing carriage 81. The lateral distance between the receiving rails 82 corresponds to the distance between the lifting rails 77. These receiving rails 82 are formed and arranged in connection with the displacing carriage 81 so that they can bring it to an aligned position with the lifting rails 77. The part of the machine frame 1 in which the lifting rails 77 extend, represents a transfer station 83 which serves for transferring the tool magazine 75 to the magazine 88. This will be explained in detail later on.

The magazine station 88 serves both for increasing the tool reservoir available for the mechanical working, and also for feeding the cutting press with other tools or exchanging individual tools.

From the above described it can be recognized that the inventive cutting press has a displacement system for the workpiece in X direction which substantially includes the ball circulating spindle 19 and is identified with reference numeral 90, as well as a displacement system for the tool in Y direction which includes substantially the ball circulating spindle 61 and is identified with reference numeral 89.

Figure 2:
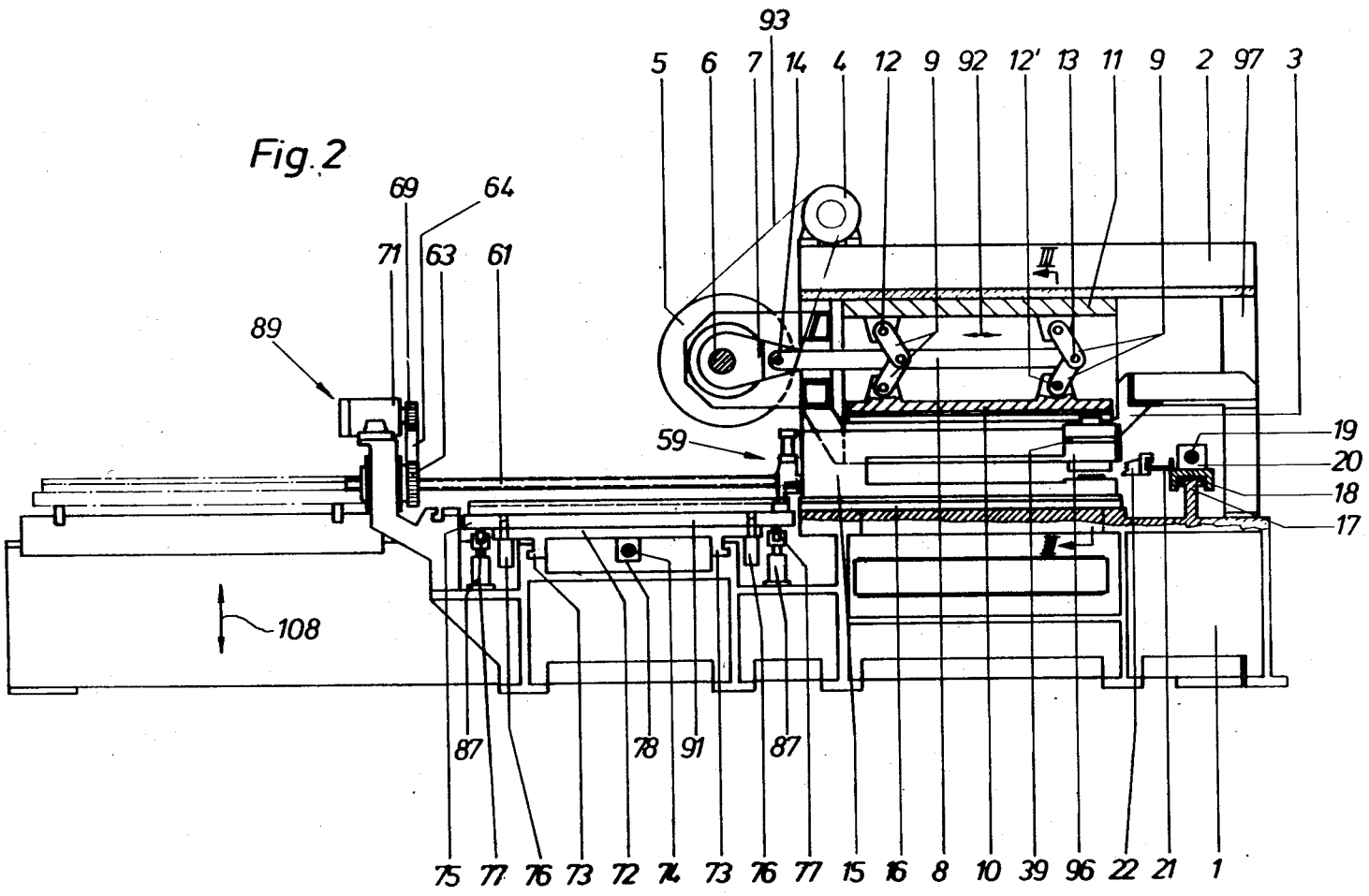
FIG. 2 is a view showing a section taken along the line II—II in FIG. 1.

In FIG. 2 and further figures, functional elements which correspond to the elements shown in FIG. 1 are identified with respective reference numerals, so as to avoid repetitions of the descriptions. It can be seen from FIG. 2 that the transverse carriage 18 is guided on a table guiding rail 17 arranged on the machine frame 1, and mounting of the clamping element 22 is performed with interposition of clamping rails 21.

The ball circulating nut 62 associated with the displacing system 89 is driven by a gear wheel 63 which is in engagement via a tooth belt 64 with a pinion 69 of a servo motor 71. The servo motor 71 is mounted in a not-shown manner on the machine frame 1.

The ball circulating spindle 61 has an end facing away of the gear wheel 63 and carries at this end a coupling element 59 which forms a connection to the tool receptacle 15 and will be described in detail later. The tool magazine 75 shown in simplified manner is supported on a magazine carriage 72 which is slidingly guided on the guiding track 73 normal to the plane of drawing of FIG. 2. For this purpose a ball circulating nut 78 is mounted on a lower side of the magazine carriage 72 and engages with the ball circulating spindle 74. Fixation of the tool magazine 75 on the magazine carriage 72 is performed by means of special centering devices 76 which operate form-lockingly as will be explained.

Lifting rails 77 are located laterally of the guiding track 73 and parallel to the latter. The lifting rails 77 are supported on cylinder-piston units 87, so that there is a possibility to lift and lower the lifting rails 77 in direction of the arrow 108. The centering devices 76 are formed also as cylinder-piston units with a cylinder mounted on the magazine carriage and a piston rod insertable into openings of the tool magazine 75 and arrestable in the same.

The above mentioned pulling post 97 is connected with the pulling post 98 which is not provided with reference numerals in FIG. 2, via a substantially horizontally extending bridge 2 in the upper part of the cutting press. A toggle lever bearing housing 11 is supported on the bridge 2. A pair of horizontal toggle levers 9 are arranged at a distance from one another in the housing 11 and actuated by a pulling rod 8. The toggle levers are turnably mounted on the toggle bearing housing by toggle lever pins 12 and on a pressing plate 10 by toggle lever pins 12'. A pulling rod pin 13 which is joined with one toggle lever pair 9 connects the same with the pulling rod 8. The pulling rod 8 has an end which faces away of the toggle levers 9 and is connected with a connecting rod 7 of an eccentric shaft 6 via a connecting rod pin 14.

The eccentric shaft 6 is driven from a motor 4 via a fly- wheel and a belt 93. Coupling elements and braking elements which are arranged functionally between the fly-wheel 5 and the eccentric shaft 6 are not shown in the drawing. Mounting of the motor 4, including the bearing of the fly-wheel 5 as well as the eccentric shaft 6 is performed on the machine frame 1. It can be recognized that rotation of the eccentric shaft 6 produces a movement of the pulling rod 8 in direction of the arrow 92, whereby the pressing plate 10 performs a displacement in direction of the arrow 108 in correspondence with the eccentricity of the eccentric shaft 6.

Reference numeral 3 identifies supporting rails which are mounted on the machine frame 1 and serve for mounting the tool receptacle 15 as will be explained. The latter is performed in the region of a guiding head 96 arranged at one end of the tool receptacle 15, by means of a groove 39 as will explained.

Figure 3:
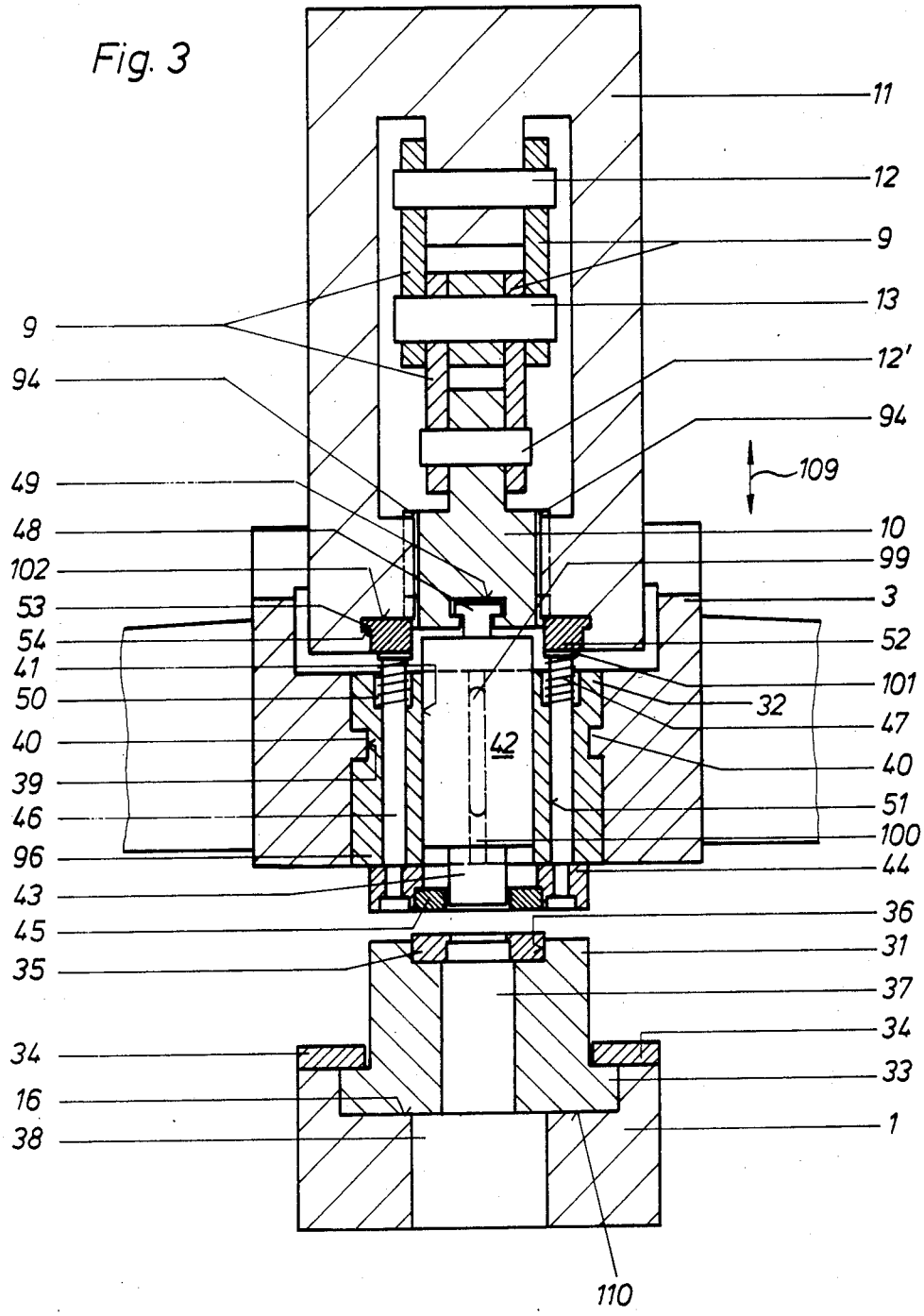
FIG. 3 is a view showing a section taken along the line III—III in FIG. 2.

FIG. 3 shows a tool set which is held in the tool receptacle 15. It includes a matrix 35, a stripper 45 and a punch holder 42 with a punch 43. The tool receptacle 15 is U-shaped, and the U is located in lying position. Its lower arm 31 is provided with an opening 36 which serves for receiving the matrix 35, whereas the guiding head 96 is mounted in its upper arm 32. This mounting is performed by grooves 39 extending substantially horizontally at both sides and engaging with guiding projections 40 formed on supporting rails 3 which extend at both sides of the guiding head 96. The stripper 45 is mounted in a stripper shoe 44 which is held by stripper pins 46 extending through the guiding head 96. The stripper pins 44 at their end facing away of the stripper shoe 44 are supported in widened openings 50 of the guiding head 96 in cooperation with spring elements 47. The spring elements 47 are supported at their ends facing away of the openings 50, on the heads of the stripper pins.

A key 99 is arranged in the guiding head 96 and guided in a guiding groove 100 of the punch holder 42. It serves for non-rotatable mounting of the same inside the guiding opening 41 in which the punch holder is arranged.

For actuating the stripper shoe 44 via the stripper pins 46 guided in openings 51, the toggle lever bearing housing 11 is slidingly guided in actuating rails 52 normal to the plane of drawing of FIG. 3. This guiding is performed via guiding projections 53 provided on the actuating rails 52. The guiding projections 53 extend substantially normal to the plane of drawing of FIG. 3 and engage in corresponding guiding grooves 54 of the toggle lever bearing housing 11.

The punch holder 42 is provided with a coupling pin 48 which is formed T-shaped in the plane of drawing of FIG. 3 and slidingly guided in a correspondingly formed longitudinal groove 49 of the pressing plate 1. The coupling pin 48 serves for transferring a pressing force to the punch 43 in direction of the arrow 109.

As can be seen from FIG. 3, the pressing plate 10 is provided with guiding projections 94 extending laterally at both sides and engaging in corresponding grooves which are parallel to the arrow 109. In this manner the pressing plate 10 is form-lockingly secured in a direction normal to the plane of drawing of FIG. 3.

Reference numeral 37 identifies a hole arranged in the lower arm 31 of the tool receptacle 15. Pieces falling during cutting or punching are evacuated through this opening.

FIG. 3 also shows exact construction and guidance of the lower part of the tool receptacle 15. In its lower region, as seen in FIG. 3, it is profiled with letter T, whereas lateral legs 33 are guided in a correspondingly designed guiding path 110 of the machine frame 1. The legs 33 are secured by covering rails 34 in a vertical direction.

Reference numeral 31 identifies in FIG. 3 a slot provided in the machine frame 1 and aligning with the opening 37. The slot 38 serves for evacuating the falling pieces and extends normal to the plane of drawing of FIG. 3 over a length which corresponds to the displaceability of the tool receptacle 15 in the working station 67.

From joint consideration of FIGS. 1–3, it can be seen that the U-shaped tool receptacle 15 is guided in the guide 16 and laterally in the grooves 39 provided in supporting rails 3, relative to a stationary drive performed by the pressing plate 10. During this guidance performed in Y direction [FIG. 1], coupling with the stationarily arranged drive is performed via a coupling pin 48 slidingly guided in a longitudinal groove 49 normal to the plane of drawing of FIG. 3. During movement of the tool in one direction the masses to be moved are retained small in this manner.

Figure 4:
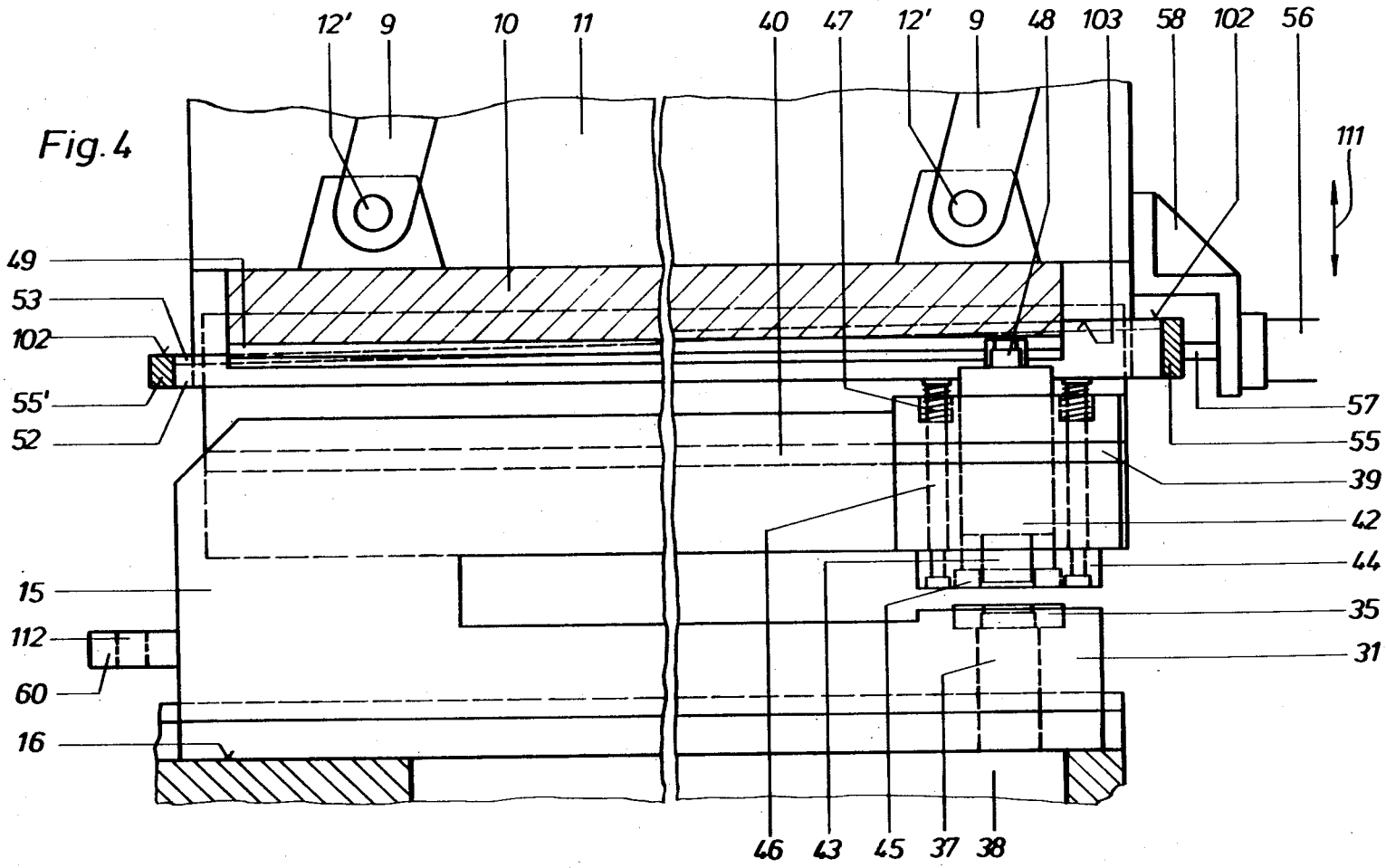
FIG. 4 is a view showing a section taken along the line IV—IV in FIG. 1, on an elongated scale.

FIG. 4 shows the construction and arrangement of the stripper pins 46 guided in the openings 51 and subjected to the action of the actuating rails 52. The actuating rails 52 which extend at both sides in the longitudinal direction of the tool receptacle 15 are connected with one another at their ends via connecting pieces 55 and 55'.

The upper edges of the actuating rails 52 extend, starting from the connecting piece 55, inclined in direction to the connecting piece 55'. These inclined upper edges are identified reference numeral 102. The upper edges 102 are in engagement with correspondingly inclined guiding surfaces 103 of the toggle lever bearing housing 11. A piston rod 57 of a cylinder-piston unit 56 is connected with the connecting piece 55. The cylinder of the latter is connected via a console 58 with the toggle lever bearing housing 11 in a not-shown manner. It can be recognized that with a pressure loading of the cylinder-piston unit 56, movement of the piston rod 57 and thereby the actuating rails 52 in direction of the arrow 110 can be produced. Because of the cooperation of the inclined upper edges 102 in connection with the above mentioned guiding surfaces 103, vertical movements of the actuating rails 52 in direction of the arrow 111 can be performed, resulting directly in vertical movements of the stripper pins 46. The stripper shoe and thereby the stripper are lifted by the same.

Reference numeral 60 identifies a coupling piece which is provided with an opening 112 and whose operation will be explained later on.

Figure 5A:
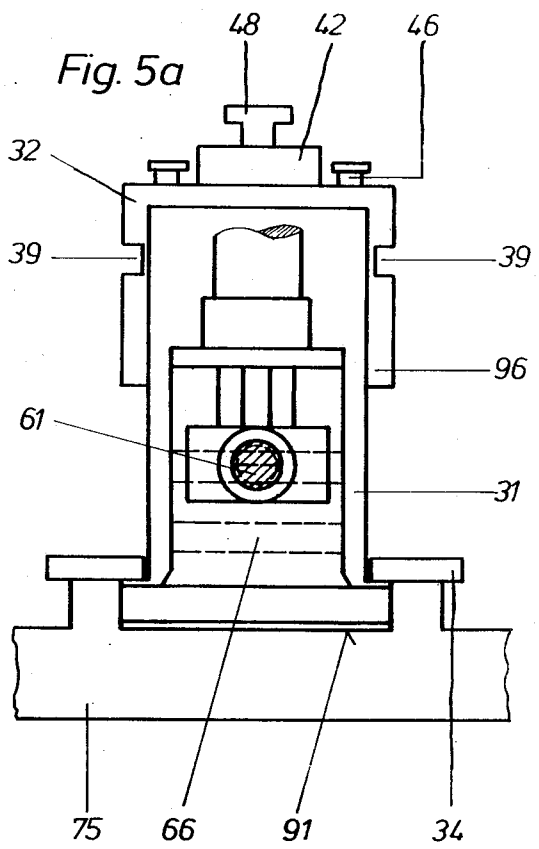
FIG. 5*a* is a view in direction of the arrow Va in FIG. 5.
Figure 5:
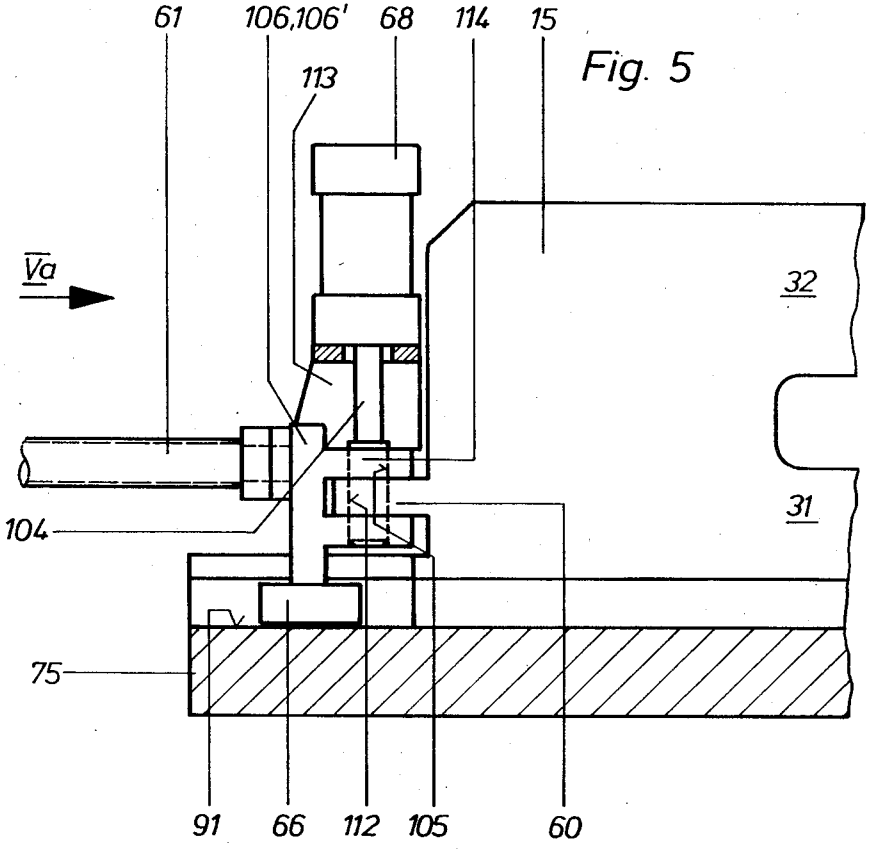
FIG. 5 is a view showing a fragment 59 of FIG. 2, on an enlarged scale.

FIGS. 5 and **5*a* show how the ball circulating spindle 61 is coupled with the tool receptacle 15. The end portion of the ball circulating spindle 61 is supported for this purpose in a fork part 106 which is slidingly supported via a guiding shoe 66 in the guiding track 91 of the tool magazine 75 or the guiding track 16 of the machine frame 1. The guiding shoe 66 has for this purpose a profile which corresponds to the dimensions of lower arm 31 of the tool receptacle 15, the lower arm having a T-shaped cross-section in FIG. 3. It can be seen from FIG. 5*a* that the guiding track 91 of the tool magazine 75 is partially covered by the covering rails 34**.

The fork part 106 forms a coupling part 106' and ends at its end facing away of the ball circulating spindle 61 in two holding elements which are arranged at a vertical distance from one another and provided respectively with mutually aligning openings 105. The opening 112 provided in the above-mentioned coupling piece 60 of the tool receptacle 15 is connected with the coupling part 106' so that it can be brought to alignment with the openings 105 of the fork part 106.

The fork part 106 carries a cylinder of a cylinder-piston unit 68 supported on a console 113. The piston rod 104 of the cylinder-piston unit 68 carries a locking cylinder 114 which is insertable into the openings 105 and 112. It can be recognized that by actuation of the cylinder-piston unit 68 in this manner, the tool receptacle 15 is coupled with the ball circulating spindle 61 and therefore can move the tool receptacle 15 in Y direction [FIG. 1]relative to a workpiece.

Figure 6:
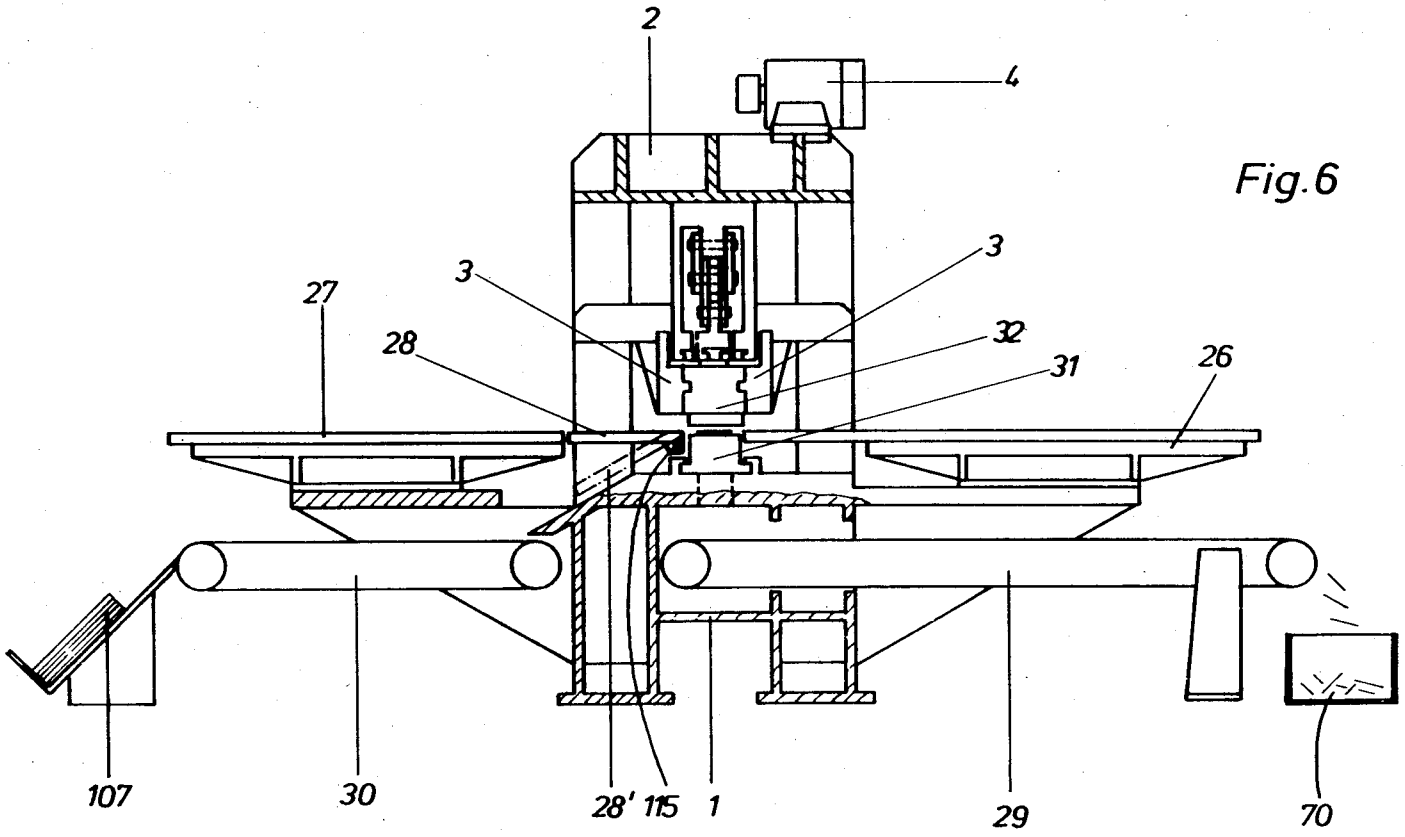
FIG. 6 is a view showing a section taken along the line VI—VI in FIG. 1.

FIG. 6 shows exact position of the conveyor bands 29 and 30 under the sheet supports 26 and 27. Metal pieces falling during the punching process are transported after this by the conveyor band 29 into a waste container 70. The finished stamped parts move by means of the flap 28 turned about an axis 115 normal to the plane of drawing of FIG. 6 to a position 28', to the conveyor band 30 and supplied by it to a stacking device 107. The stacking device 107 is formed in this case substantially as a simple angle sheet.

Figure 7:
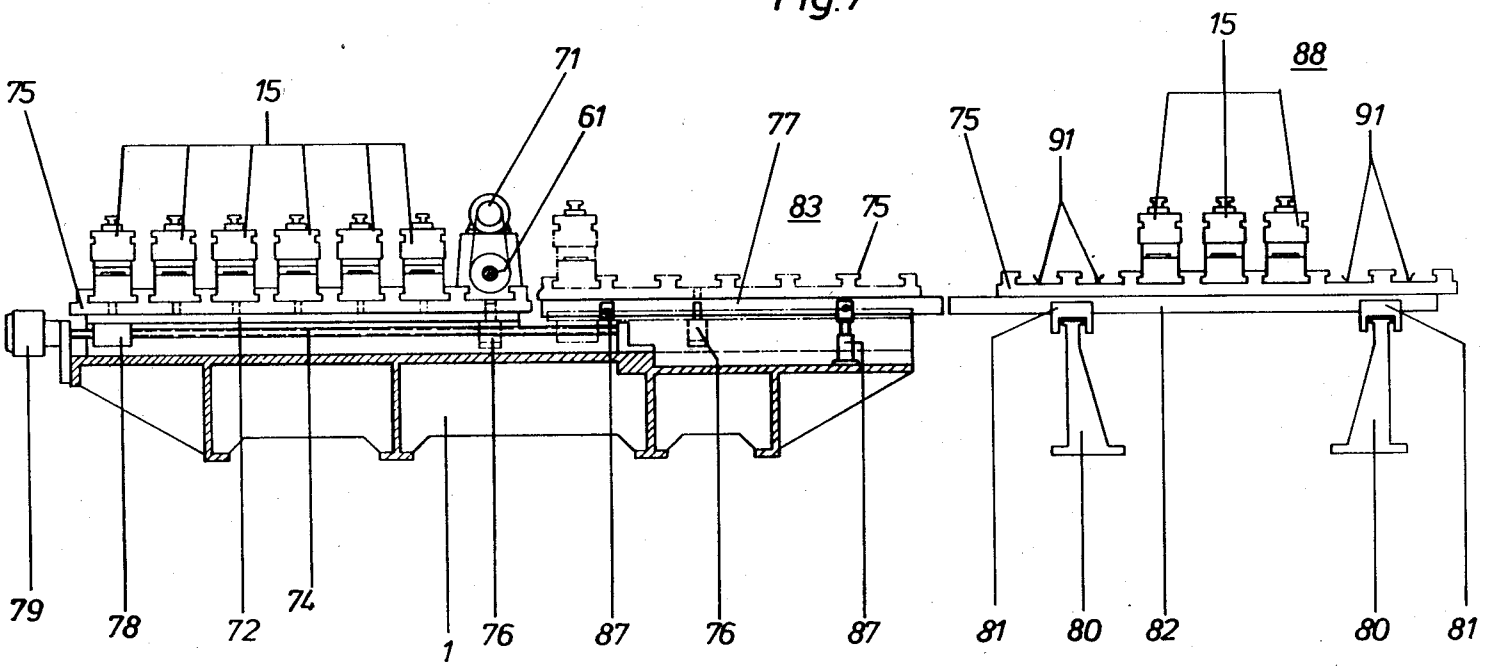
FIG. 7 is a view showing a section taken along the line VII—VII in FIG. 1.

FIG. 7 illustrates the construction of the drive of the tool magazine 75 in X direction. The ball circulating nut 78 is mounted on the magazine carriage 72 and engages with the ball circulating spindle 74. During rotation of the ball circulating spindle 74 by means of the servo motor 79 the tool magazine held by the centering devices 76 on the magazine carriage 72 is moved as a whole in X direction.

With a complete movement in the transferring station 83, the tool magazine 75 can be transferred in X direction to the receiving rails 82, after loosening of the centering devices 76 and lifting the lifting rails 77 by means of the cylinder-piston units 87. This process of transferring from the lifting rails 77 to the receiving rails 82 can also be performed by means of a drive which is not shown here. In the magazine station 88 located laterally near the transferring station 83, the tool magazine 75 located on the displacing carriage 81 is supported displaceably normal to the plane of drawing of FIG. 7.

Figure 8:
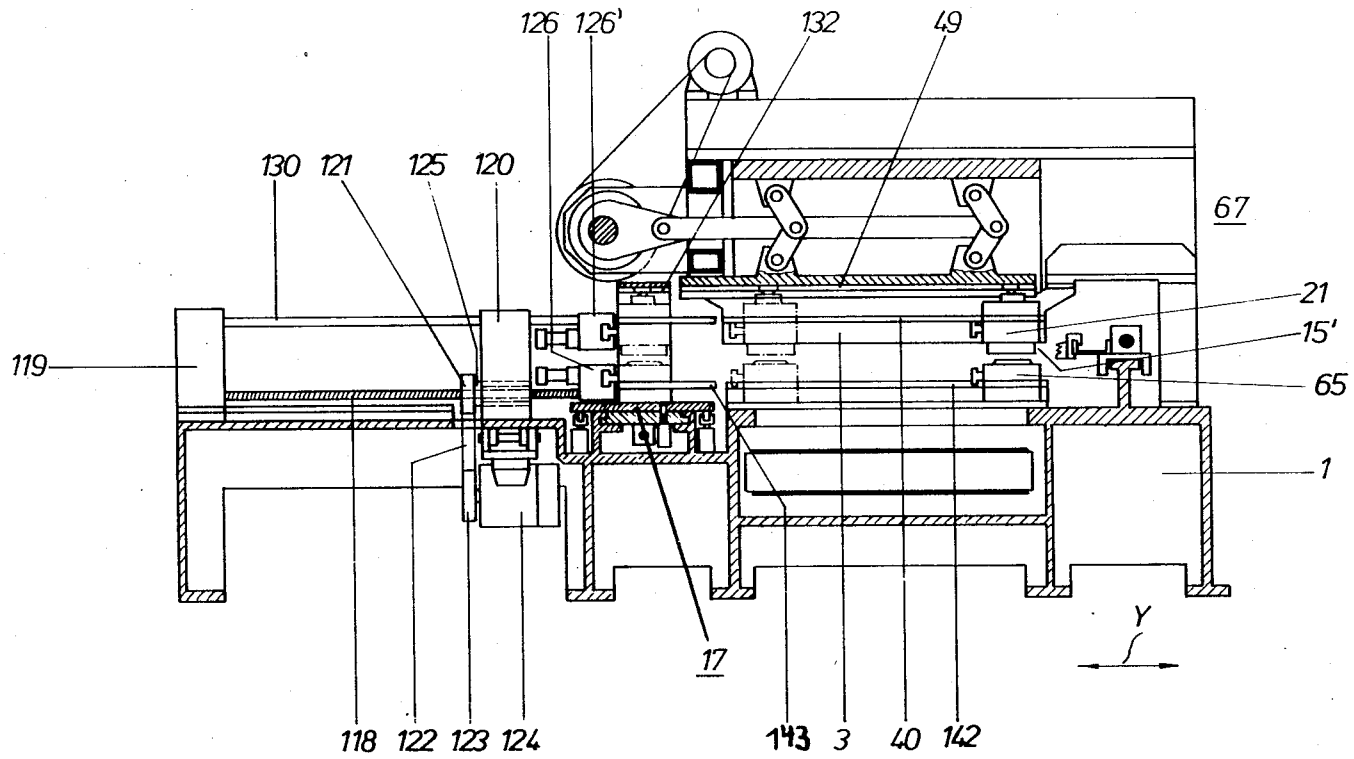
FIG. 8 is a view showing a cutting press in a section along the line I—I in FIG. 1, but with another tool receptacle.
Figure 9:
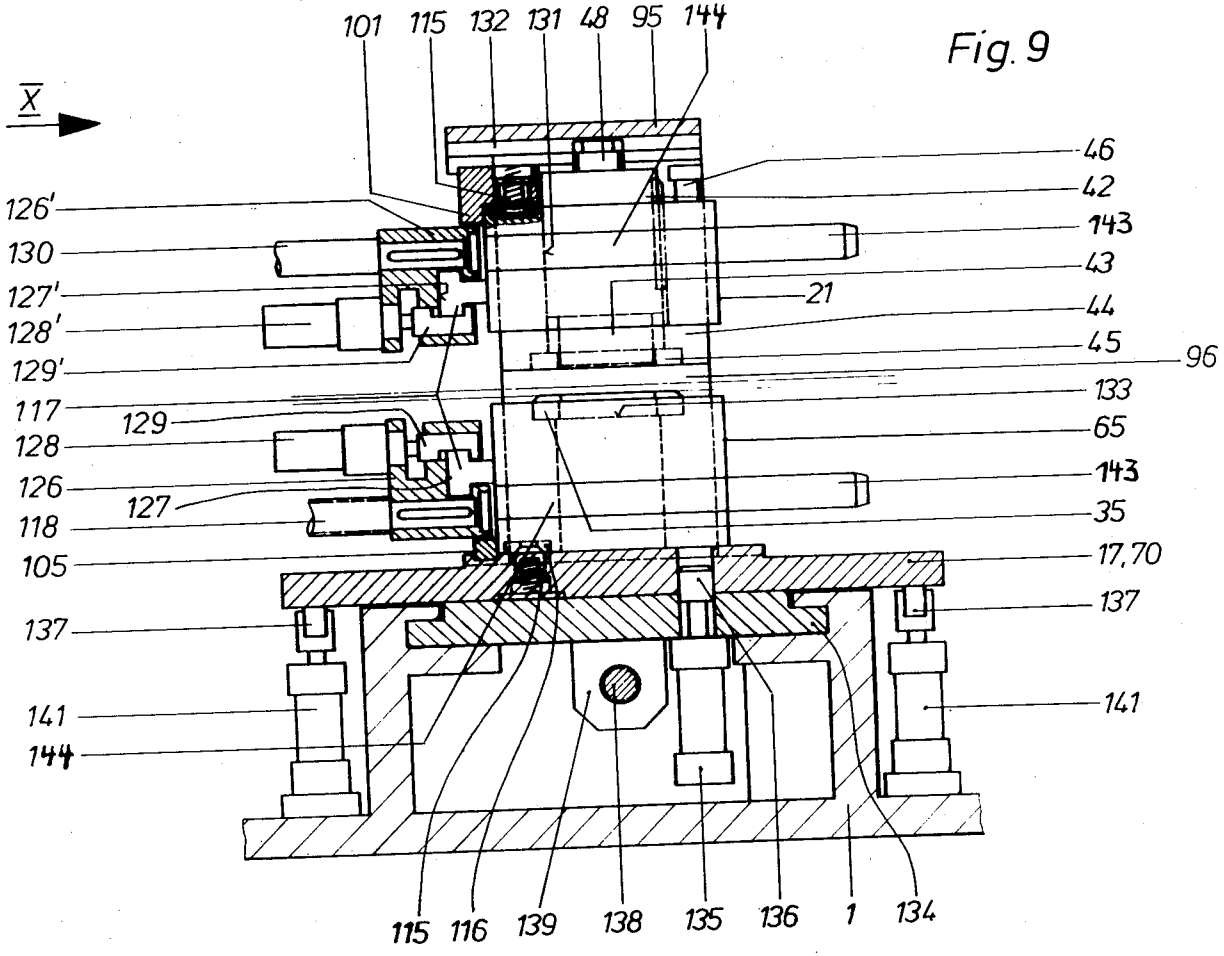
FIG. 9 is a view showing the tool receptacle of FIG. 1, on an enlarged scale.
Figure 10:
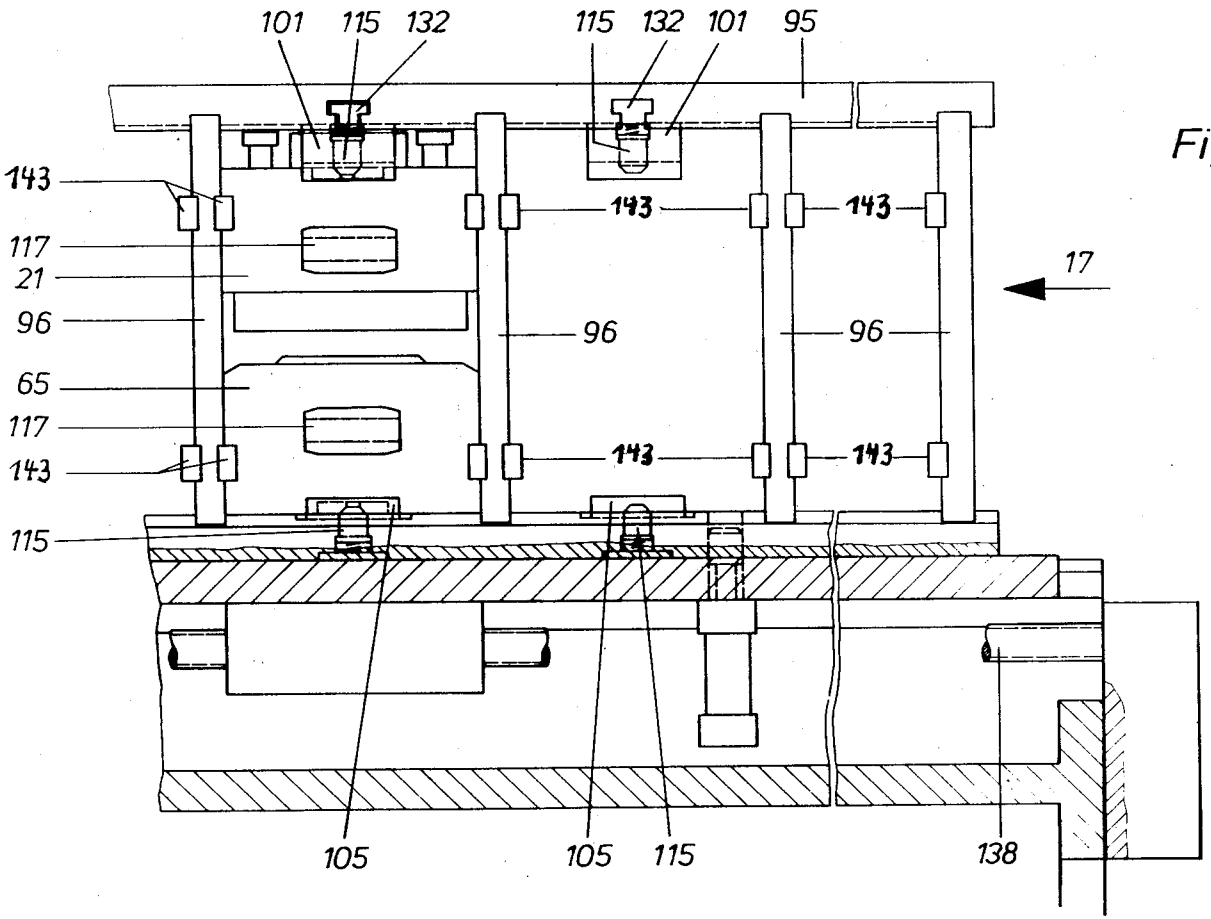
FIG. 10 is a view in direction of the arrow X in FIG. 9 partially in section.

FIGS. 8–10 show another embodiment of the invention in which in the tool magazine 17, instead of U-shaped cooperating tool receptacles 15, two-part tool receptacles 15' are provided. They include respectively the punch holder guide 21 and the separate matrix guide 65. The tool magazine 17 includes the magazine base plate 70 and a magazine covering plate 95 which are connected with one another by magazine intermediate walls 96 arranged at a distance from on another. The magazine intermediate walls 96 are provided respectfully for the punch holder guide 21 and for the matrix guide 65 with a pair of substantially horizontally extending transferring rails 143. The transferring rails 143 have a lateral distance and a construction coinciding with the guiding projections 40 of the supporting rails and cooperating with them in a manner which will be explained.

The punch holder guide 21 and the matrix guide 65 are provided at both sides with guiding grooves 144 which have dimensions corresponding to the transferring rails 143 and can be brought in engagement with the latter. Therefore both the punch holder guide 21 and the matrix guide 65 are introduced during insertion into the tool magazine 17, to an abutment which is determined for the punch holding guide 21 by an angular part 101 and for the matrix receptacle 65 by an angular part 105. In this position both the punch holder guide 21 and the matrix receptacle 65 are secured in the magazine relative to the tool magazine 17 by spring loaded arresting pins 15 which engage in respective openings 116 of the punch holder guide 21 or the matrix guide 65.

Both the punch holder guide 21 and the matrix receptacle 65, as shown in FIG. 9, are provided at one end with a T-shaped coupling piece 117. It serves for their displacement in Y direction relative to the tool magazine 17.

For providing such a displacement, a ball circulating spindle 118 is supported with its one end in a connecting block 119 displaceable relative to the machine frame 1 in Y direction, and with its other end in a bearing block 120 mounted on the machine frame 1. The drive is performed via a gear wheel 121 which is in engagement with a servo motor 124 via a toothed belt 122 with a pinion 123. Displacement of the spherical ball circulating spindle 118 in Y direction is performed by means of a rotatably supported ball circulating nut 125 which is axially supported at one side relative to the gear wheel 121 and at the other side relative to the bearing block 120.

The ball circulating spindle 118 has an end which faces away of the bearing block 120 and carries a coupling part 126 which has a receiving groove 127 for receiving the coupling piece 117. The coupling piece is insertable into the receiving groove 127 normal to the plane of drawing of FIG. 9. The coupling part 126 for mounting in the receiving groove 127 carries a cylinder-piston unit 128. A piston rod of the cylinder-piston unit 128 carries a clamping part 129 which is designed for engaging behind the T-shaped coupling piece 117.

A pushing rod 130 extends at a distance above the ball circulating spindle 118. It extends through the bearing block 120 and carries at its end a coupling part 126' formed in correspondence with the coupling part 126. The coupling part 126 is provided in the same manner with a cylinder-piston unit 128', a receiving groove 127' and a clamping piece 129'. The arrangement of the coupling part 126' is performed so that it can engage the coupling piece 117 associated with the punch holder guide 21.

Inside the punch holder guide 21, the punch holder 42 is inserted in a punch holder opening 31, and the coupling pin 48 is held in a punch holder groove 132 which has a T-shaped cross-section and is formed in the magazine covering plate 95. The matrix 35 is inserted in receiving opening 133 of the matrix guide 65.

The tool magazine 17 or its magazine base plate 70 is arrested in horizontal direction by means of several cylinder-piston units 135 each associated with a centering pin 136. The magazine carriage 134 is in turn supported in motor-movable manner in a guiding track 140 of the machine frame normal to the plane of drawing of FIG. 9. Its movement is performed by means of a ball circulating spindle 138 which is driven analogously to the ball circulating spindle 70 of FIG. 1 by means of a servo motor. The drive of the magazine carriage 134 is performed via a ball circulating nut 139 mounted on the same. Reference numeral 137 identifies lifting rails arranged at both sides of the guiding path 140. Analogously to the lifting rail 77 of FIG. 1, they serve for separation of the tool magazine 17 from the magazine carriage 134. For this purpose cylinder-piston units 141 are located under the lifting rails 137 and make possible lifting of the tool magazine 17 relative to the magazine carriage 134.

The punch holder groove 132 of the tool magazine 17 can move to such a position in which it extends in alignment with the longitudinal groove 49 of the pressing plate 10. The machine frame 1 is provided moreover in its working station with a pair of guiding projections 142 which has a cross-section corresponding to the cross-section of transferring rail 143 and arranged under the guiding projections 40. The lower transferring rails 143 of the tool magazine can be brought in a horizontal aligning arrangement to the guiding projections 142.

The operation of both different embodiments in accordance with FIGS. 1–7 on the one hand and 8–10 on the other hand will be explained shortly herein below.

For the first embodiment it is important that the whole tool set be located in a respective tool receptacle 15, whereas the respective tool set is removable from the tool magazine 75. For bringing a predetermined tool set into the working station 67, by actuation of the servo motor 79 the respective tool set of the tool magazine is moved to a position suitable for insertion into the working station 67 and subsequently by actuation of the servo motor 71 the tool set is moved in Y direction. Simultaneously the sheet to be worked which is held by the clamping elements 22 on the transverse carriage 18, is moved by means of the servo motor 25 in X direction. By moving the tool magazine 75 by means of the servo motor 79 in the transfer station 83, the tool magazine 75 can be separated from the respective magazine carriage 79 by actuation of the lifting rails 77 by means of the associated cylinder-piston units 87, and moved horizontally into the magazine station 88. The last step is preferably performed by a motor. The magazine station 88 forms in principle a support for a plurality of tool magazines in which simultaneously whole tool sets or tool receptacles can be exchanged in accordance with a respective working program. In the magazine station 88 the tool magazine 75 is displaceably supported transverse to X axis, or in other words in direction of Y axis. This displacement step of the magazine 75 into the magazine station 88 is also advantageously performed by a motor. For exchanging the tool receptacle 15 introduced into the working station 67, it must be completely retracted from the same, so that subsequently the tool magazine 75 can be moved in correspondence with the position of the new tool receptacle 15 to be inserted in the X direction. It is essential that during movement of the tool set its drive, namely the pressing plate is not taken along with the displacement movement in Y direction, because of special construction of the coupling device between it and the tool receptacle. In this manner the masses which are to be moved during the tool are retained small. For performing a punching or cutting press process proper, the stripper 45 is moved downwardly by activation of the cylinder-piston unit 56 onto the sheet to be punched, which is performed by horizontal displacement of the actuating rails 52. By their inclined upper edge 102 in connection with the guiding service 103 of the toggle lever bearing housing 11, the stripping pin 46 acts against the action of the fixing spring elements via the stripping shoe 44 onto the stripper 45. The pressure transmission to the punch 43 is performed subsequently via the toggle lever 9, whereas the pieces falling during the punching process fall through the slot 38 onto the conveyor band 29 located there under. A retraction of the punch is performed by means of the toggle lever 9, whereas retraction of the stripper is performed by activation of the cylinder-piston unit 56 in opposite direction.

In the embodiment of FIGS. 8–9 the space consumption for the tool receptacle which is not formed here as a self-contained body, is reduced. However, the kinematics of the movements which take place during mechanical working is similar to the above described embodiment. The set of tools located in the working station 67 is moved by means of the servo motor 124 in Y direction. Simultaneously, the punch holder guide 21 and the matrix guide 65 release their locking by the arresting pins 115 and move along the transferring rails 143. At their ends, by further movement in one direction they are taken by the projections 40 and 142. Simultaneously the coupling pin 48 of the punch 43 is displaced outwardly from the punch holding groove 133 of the tool magazine 17 and inserted into the longitudinal 49 of the pressing plate 10. The process of withdrawal from the region of the pressing plate 10 or the working station 67 takes place in a reversed order. It can be recognized that a lateral displacement of the tool magazine 17, normal to the plane of drawing of FIG. 8, is possible only when the coupling part 126 or 126' which can move only jointly are located in the end position which is shown in FIG. 8 since only in this position the respective tool set is completely drawn into the tool magazine 17.

The drive elements of the inventive cutting press are connected in an NC or a CNC control. Description of a respective electrical functional element such as positioners, end switches and the like is dispensed with.

It will be understood that each of the elements described above, or two or more together, may also find a useful application in other types of constructions differing from the types described above.

While the invention has been illustrated and described as embodied in a cutting press, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A cutting press for working plate-shaped workpieces, comprising a machine frame having a working table on which workpieces are rectilinearly motor movable in a direction X; means for rectilinearly moving the workpieces on said working table in the direction X; a working station in which a pressing plate overlaps said working table in a direction Y substantially normal to the direction X; tool receptacles displaceable in the direction Y under said pressing plate and containing a tool including a complete tool set, said pressing plate having a lower side which forms a driving device for reciprocating said pressing plate in direction toward and away of the tool located thereunder; a driving system for displacing said tool receptacles in the direction Y and arranged stationary at said working station; a tool magazine in which said tool receptacles are arranged; a magazine station for receiving said tool magazine, said tool magazine being motor movable between a position forwardly of said working station and said magazine station in the direction X; motor drive means for moving said tool magazine in the direction X, said tool receptacles being aligned with said pressing plate and movable in the position forwardly of said working station, in the direction X; a drive system for moving said tool receptacles in the direction X, each of said tool magazines being movable stepwise forwardly of said working station in the direction X so as to transfer the respective tool receptacles to said working station, said tool magazines being arranged displaceably inside said magazine station normal to the direction X so that a respective tool magazine located in a point of a displacement path inside said magazine station is transferable to the position forwardly of said working station in the direction X so that from said magazine station any tool magazine can be transferred to the position forwardly of said working station and vice versa, said drive system for displacing said tool receptacles in the direction Y having coupling parts, said tool receptacles having coupling pieces cooperating with said coupling parts, said pressing plate being provided with a longitudinal groove which extends in the direction Y so as to vertically form-lockingly fix said tool formed as a punch.

2. A cutting press as defined in claim 1, wherein said tool receptacles are formed as one-piece elements.

3. A cutting press as defined in claim 2, wherein said tool receptacles are U-shaped and arranged in a lying position, each of said tool receptacles with said upper and lower end arms contain the tool including a punch, a stripper and a matrix.

4. A cutting press as defined in claim 3, wherein said upper arm and said lower arm of each of said tool receptacles are provided with guiding devices which cooperate with said machine frame, said arms being horizontally slidingly guided and vertically supported at all sides.

5. A cutting press as defined in claim 1, wherein each of said tool receptacles is composed of two parts including an upper and a lower part provided with guiding devices which cooperate with said machine frame, said parts being horizontally slidingly guided and vertically supported at all sides, and said parts supporting the tool including a punch, a stripper and a matrix.

6. A cutting press as defined in claim 1; and further comprising a punch holder provided for the punch and having a coupling pin, said coupling pin being slidingly guided in said longitudinal groove in the direction Y, but vertically fixed at all sides.

7. A cutting press as defined in claim 1, wherein said pressing plate is vertically slidingly guided relative to said machine frame, but fixed horizontally at all sides.

8. A cutting press as defined in claim 1, wherein said coupling plate is connected with two pairs of toggle levers arranged at a distance from one another in the direction Y, said both pairs of toggle levers being connected with one another by a common substantially horizontal pulling rod, said pulling rod being oscillatingly driveable in direction of its elongation.

9. A cutting press as defined in claim 8; and further comprising a toggle lever bearing housing fixedly connected with said machine frame, said pairs of toggle levers being arranged in said toggle lever bearing housing, said toggle lever bearing housing having an open region in which said coupling is slidingly guided, said toggle levers being turnably supported at one side on said toggle lever bearing housing and on the other side on said coupling plate; and further comprising toggle lever pins connecting said toggle levers with said toggle lever bearing housing and said coupling plate.

10. A cutting press as defined in claim 3; and further comprising stripper pins which are held with spring force in said upper and said lower arm of said tool receptacle parallel to the punch, and actuating rails which are slidingly arranged on said machine frame for moving said stripper pins, said actuating rails extending in the direction Y and being motor sliding in said direction relative to said machine frame, said actuating rails having a longitudinal surface which is in sliding contact with said stripper pins and each having an inclined sliding surface which is inclined relative to a horizontal plane and in the direction Y, said machine frame having respectively inclined guiding surfaces with which said inclined sliding surfaces of said actuating rails are in sliding contact.

11. A cutting press as defined in claim 10, and further comprising two pairs of toggle levers arranged at a distance from one another in the direction Y and cooperating with said pressing plate, and a toggle lever bearing housing in which said pairs of toggle levers are arranged, said actuating levers extending in the direction Y at both sides of said pressing plate, and said guiding surfaces being formed in said toggle lever bearing housing.

12. A cutting press as defined in claim 1, wherein said coupling parts of said drive system are formed motor switchable.

13. A cutting press as defined in claim 1, wherein said drive system includes a ball circulating spindle and a ball circulating nut, said ball circulating nut being motor driven, and said ball circulating spindle having two ends of which one end is supported on said machine frame via said ball circulating nut and the other end carries at least one of said coupling parts.

14. A cutting press as defined in claim 13, wherein each of said tool receptacles have two parts including an upper part and a lower part provided with said coupling pieces each associated with a respective one of said coupling parts of said drive system; and further comprising a connecting rod extending parallel to said ball circulating spindle and kinematically coupled with the latter, and a connecting block which kinematically couples said connecting rod with said ball circulating spindle, one of said coupling parts being movable in the direction Y via said ball circulating spindle and the other of said coupling parts being movable in the direction Y via said connecting rod.

15. A cutting press as defined in claim 1; and further comprising a magazine carriage arranged so that said tool magazine is movable on said machine frame with interposition of said magazine carriage.

16. A cutting press as defined in claim 15, wherein said tool magazine is mechanically controllable on said magazine carriage, but is releasably centered.

17. A cutting press as defined in claim 1, wherein said magazine carriage is movable in a predetermined direction, said tool magazine located in said magazine being located transverse to the direction of movement of said magazine carriage.

18. A cutting press as defined in claim 1, wherein each of said tool receptacles is formed as a one-piece C=shaped member.

19. A cutting press as defined in claim 1, wherein each of said tool receptacles is formed as a two-part member including an upper part and a lower part.

* * * * *